United States Patent [19]

Kärnä

[11] Patent Number: 4,608,944

[45] Date of Patent: Sep. 2, 1986

[54] IGNITION DEVICE FOR FLUIDIZED BED BOILER

[75] Inventor: Toivo Kärnä, Porvoo, Finland

[73] Assignee: Neste Oy, Finland

[21] Appl. No.: 701,982

[22] Filed: Feb. 15, 1985

[30] Foreign Application Priority Data

Feb. 17, 1984 [FI] Finland ..... 840670

[51] Int. Cl.[4] ..... F23B 1/02

[52] U.S. Cl. ..... 122/4 D; 110/245; 110/250; 110/263; 431/28; 432/58

[58] Field of Search ..... 110/245, 263, 254, 303, 110/306, 308, 250; 122/4 D; 432/58; 431/11, 28, 170, 208

[56] References Cited

U.S. PATENT DOCUMENTS

| | | | |
|---|---|---|---|
| 4,183,308 | 1/1980 | Toth | 122/4 D X |
| 4,249,472 | 2/1981 | Mitchell | 110/245 |
| 4,249,889 | 2/1981 | Kemp | 432/58 X |
| 4,308,810 | 1/1982 | Taylor | 122/4 D X |
| 4,392,818 | 7/1983 | Wunning | 431/11 X |
| 4,407,355 | 10/1983 | Bonn et al. | 122/4 D X |
| 4,408,984 | 10/1983 | Forster | 431/208 X |
| 4,416,418 | 11/1983 | Goodstine et al. | 122/4 D X |

*Primary Examiner*—Albert J. Makay
*Assistant Examiner*—Steven E. Warner
*Attorney, Agent, or Firm*—Steinberg & Raskin

[57] ABSTRACT

The present invention concerns an ignition device for igniting fuel within a heating boiler having a combustion section operating according to the fluidized bed principle. The ignition device comprises a jacket-like body portion with a surface facing away from the fluidized bed of particles such as sand being furnished with a heating member, and the surface of the jacket-like body portion facing the fluidized bed of particles having heat transfer elements. The heat transfer elements may be rib-shaped, while a lagging or equivalent structure may encircle the ignition device, to form an intermediate space therebetween through which combustion gas is arranged to flow into the jacket-like body portion. A member for pre-heating the combustion gas flowing through this intermediate space, may also be provided, which is in turn cooled by the inflowing combustion gas.

8 Claims, 8 Drawing Figures

IGNITION DEVICE FOR FLUIDIZED BED BOILER

BACKGROUND OF THE INVENTION

The present invention is directed to an ignition device for igniting a heating boiler having a combustion portion operating according to the fluidized bed principle.

Small heating boilers using solid fuels such as coal, peat and wood, are usually based upon grating combustion. There has been extensive experience with boilers having grating. Such boilers are simple and inexpensive to construct. However, drawbacks of such boilers include their low efficiency, and combustion products therefrom which are harmful to the environment, especially when the boiler is operating with a small load.

Automatic fuel feed into such a boiler is expensive, when the fuel is of large size (e.g. cordwood or chopped fire wood). With many kinds of fuel such as peat and straw pellets or certain grades of coal, fusing of ash and sintering thereof into a cake upon the grating impedes the use of such fuels. The sintered slag is removable with the aid of various mechanical mechanisms, however in many instances, such mechanisms interfere with the combustion in a small boiler.

Small boilers with grating combustion of the prior art have numerous disadvantages. The efficiency is poor with varying loads. Suitability of such small boilers for varying types of fuel is also unsatisfactory. Moreover, operation of such small boilers is labor-intensive.

Fluidized bed boilers are large in size and complex in construction. Therefore, these type of boilers which are known at present are not applicable to the class of small boilers.

A fluidized bed boiler is ignited either electrically, or, in the case of larger boilers, with oil or gas. When oil or gas is used, ignition takes place in a manner such that an oil or gas burner directly heats the bed of sand or the hot flue gases used for fluidizing. In the latter situation, a fluidized air blower blows air into a separate pre-heating chamber, which is provided with an oil or gas burner. The burner draws its air for combustion from the fluidized air flow.

A small fluidized bed boiler has been electrically ignited, in that an electric heating resistance has been placed in the input line leading to the air supply chamber of the boiler, as disclosed for example in U.S Pat. No. 4,183,308. In that case, a normal electrical air heater is involved. The drawback of this particular prior art device, is the poor heat transfer to the air.

In Finnish Patent Application No. 82 3267, an electrical ignition is disclosed, wherein the electric heating element has been disposed in the combustion portion, operating according to the fluidized bed principle, of the boiler. In this prior art device, the heat transfer from the resistance to the fluidized sand is efficient, but not uniform, as a consequence of which the resistance may be locally overheated. Since the resistance has been disposed in the lower portion of the sand layer, which is at rest during combustion, this device requires ample space, with the quantity of sand that must be heated at ignition being large. It is furthermore difficult to automate the ignition, because the ignition has two phases and requires, for instance, two sets of air nozzles.

SUMMARY OF THE INVENTION

Accordingly, it is an object of the present invention to achieve improvement over presently-known ignition devices that have been used in fluidized bed boilers.

It is another object of the present invention to improve efficiency of heat transfer within an ignition device for a fluidized bed boiler.

It is a more specific object of the present invention to provide an ignition device for a fluidized bed boiler, which enables heating at the starting phase to be executed outside of the combustion portion of the boiler, so that heat will be transferred to the bed of fluidized particles such as sand, with the aid of a heat transfer member forming part of the ignition device, as efficiently as possible.

It is a further object of the present invention to achieve radial mixing of fluidized particles such as sand with fuel, and partial vortical movement of flue gases during the combustion phase in a fluidized bed boiler.

These and other objects are attained by the present invention which provides an ignition device comprising a jacket-like outer portion, with a surface facing away from a fluidized bed of particles such as sand being furnished with a heating element, and the surface facing towards the fluidized particles or sand being provided with heat transfer members.

In a particularly preferred embodiment of the present invention, the heat transfer members are rib-shaped heat transfer elements which are either straight, i.e. substantially parallel to the longitudinal direction of the jacket-like body, or are inclined at an angle with respect to the longitudinal direction of the jacket-like body, such angle being in the range of 0° to 70°, preferably in the range from 0° to 50°.

The heating member forming a part of the ignition device of the present invention, may be an electrical heating element or any other type of heating element, e.g. a heating fluid.

In one embodiment of the present invention, the heating member is also a jacket-like member, having a surface facing towards a bed fluidized particles such as sand being fitted with heat transfer elements too.

In one specific application of the invention, an intermediate space is provided between the jacket-like body portion of the ignition device, and a lagging or equivalent structure of the ignition device, with the combustion gas such as air being disposed to flow through the intermediate space and into the jacket-like body portion. A heating member is also disposed to preheat the combustion air flowing through this intermediate space.

Numerous significant advantages are attained with the ignition device of the present invention. The ignition device of the invention, which is actually both a start-up and a combustion section, serves to heat up the fluidized sand to the fuel ignition temperature during the starting phase, and also as a combustion section during operation of the heating boiler itself. Heating at the starting phase is accomplished from outside the combustion section, e.g. with an electrical resistance or with another heating member. The heat is efficiently transferred into the fluidized sand, with the aid of rib-shaped heat transfer elements.

When the rib-shaped heat transfer elements are inclined with respect to the longitudinal axis or direction of the jacket-like body portion of the ignition device, radial mixing of the fluidized sand with the fuel, along with partial vortical motion of the fuel gas, is achieved during the combustion phase.

The ignition device of the present invention simplifies automatic start-up of the boiler, and may also be applied in heating boilers having a higher power rating. The ignition device of the present invention reduces the required height dimension of the overall apparatus, a significant advantage in the case of small boilers.

BRIEF DESCRIPTION OF THE DRAWINGS

The present invention will now be described in greater detail with reference to certain preferred embodiments thereof illustrated in the figures of the accompanying drawings, but to which the present invention is not meant to be exclusively confined. In the drawings.

DETAILED DESCRIPTION OF THE PREFERRED EMBODIMENTS

Figure 1:
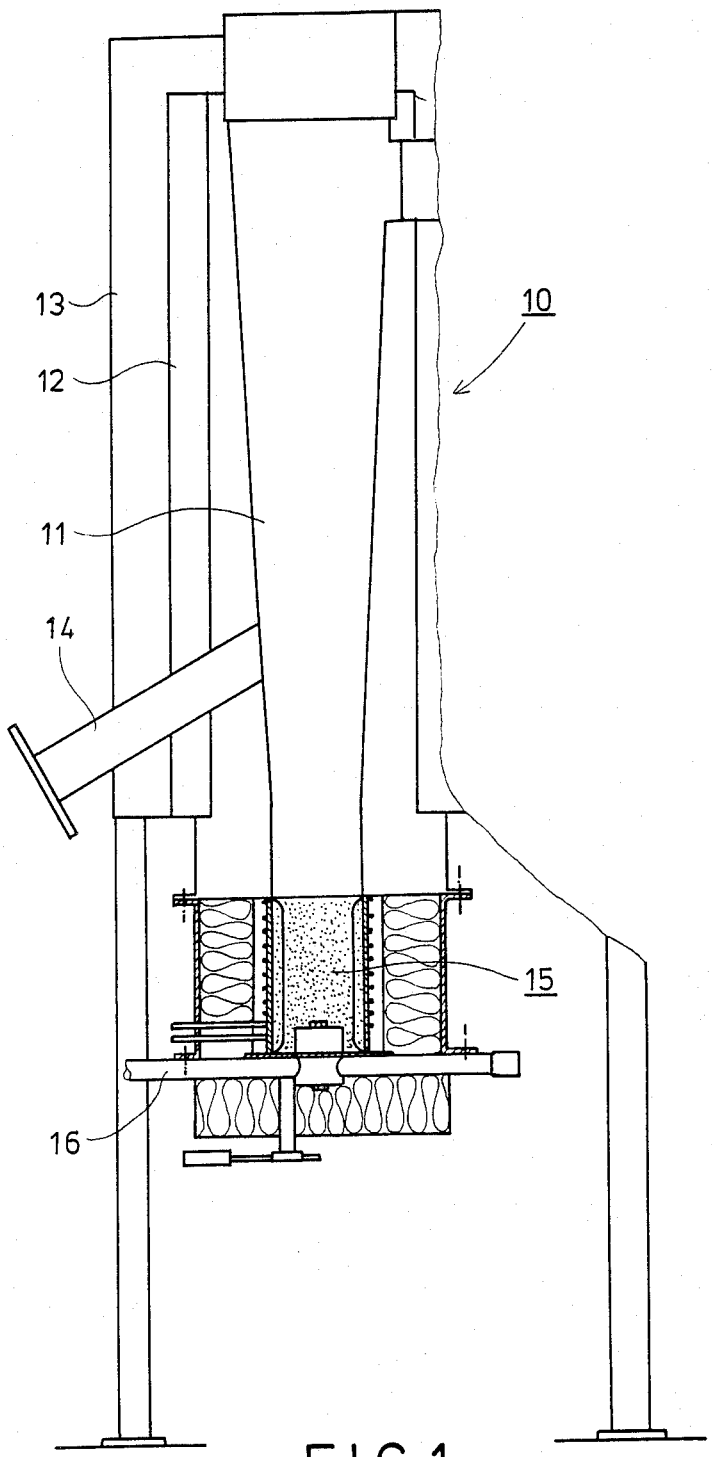
FIG. 1 is a schematic cross-sectional view of a fluidized bed heating boiler which is provided with an ignition device according to the present invention.

In the embodiment illustrated in FIG. 1, the heating boiler is generally indicated by the reference numeral 10. The heating boiler 10 contains a combustion portion 11 operating according to the fluidized bed principle. Water volume has been indicated by reference numeral 12, with the outer jacket of the heating boiler 10 being provided with a lagging 13. Reference numeral 14 indicates the fuel introduction point, while the ignition device of the present invention has been generally indicated by the reference numeral 15. Reference numeral 16 indicates the air inflow connector.

Figure 2:
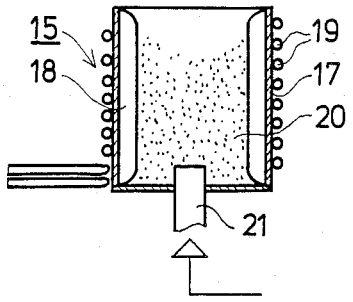
FIG. 2 is a schematic cross-sectional view of a preferred embodiment of the ignition device of the invention, for application on a heating boiler as in FIG. 1.
Figure 3:
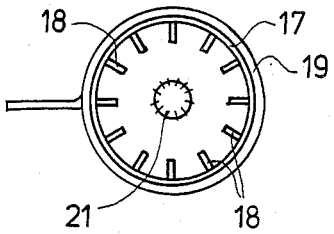
FIG. 3 is a top view of the ignition device of FIG. 2.

A preferred embodiment of the ignition device 15 of the present invention has been illustrated in FIGS. 2 and 3. In this embodiment, the ignition device 15 comprises a jacket-like body portion 17, with the surface thereof facing the fluidized bed of sand 20 being provided with heat transfer elements 18, while the opposite surface thereof facing away from the fluidized bed of sand 20 is concomitantly provided with heating elements 19. In this particular embodiment, the heat transfer elements 18 are rib-shaped, and parallel the jacket 17, i.e. extend substantially parallel to a longitudinal axis of the jacket-like body portion 17. Additionally, in this particular embodiment, the heating element 19 is disposed as a helical electrical resistance. A tube 21 through which combustion air is arranged to flow into the fluidized sand 20, is provided at the bottom of the jacket-like body portion 17, as illustrated in FIG. 2.

Figure 4:
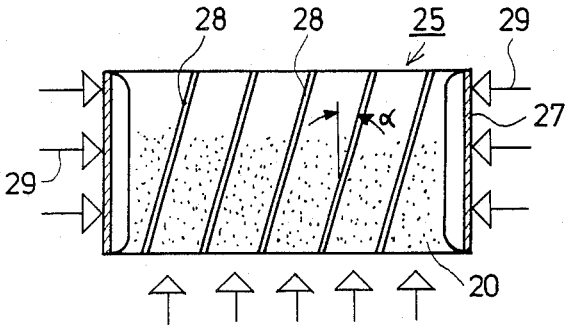
FIG. 4 is a schematic cross-sectional view of another preferred embodiment of the ignition device of the present invention for application on a heating boiler of FIG. 1.
Figure 5:
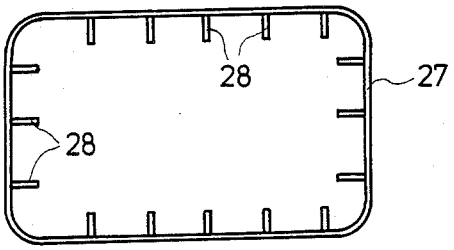
FIG. 5 is a top view of the ignition device of FIG. 4.

In the embodiment illustrated in FIGS. 4 and 5, the ignition device according to the present invention has been generally indicated by the reference numeral 25. In this embodiment also, the ignition device 25 comprises a jacket-like body portion 27, of which the surface facing the fluidized sand 20 is provided with rib-shaped heat transfer elements 28. The surface of the jacket-like body portion 27 facing away from the fluidized sand 20 has been furnished with a heating element 29, which is represented in FIG. 4 by a heat flow schematically indicated by the arrows. In this particular embodiment, the rib-shaped heat transfer elements 28 are inclined with respect to the longitudinal direction or axis of the jacket-like body portion 27, at an angle $\alpha$. The magnitude of the angle $\alpha$ is in the range of 0° to 70°, preferably in the range of 0° to 50°.

Figure 6:
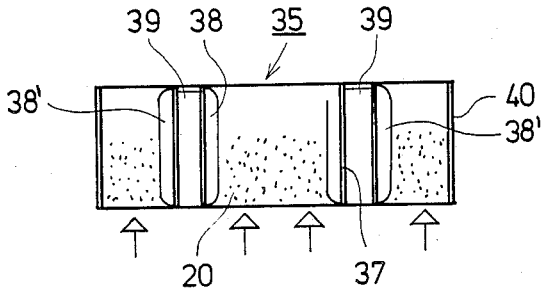
FIG. 6 is a schematic cross-sectional view of a third preferred embodiment of the ignition device of the present invention for application on a heating boiler as in FIG. 1.
Figure 7:
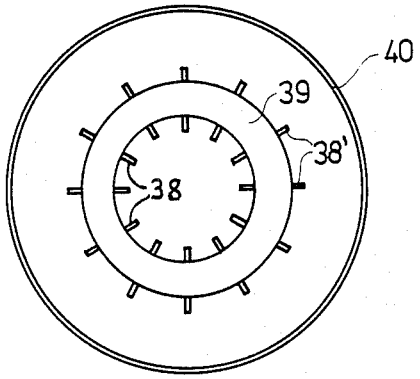
FIG. 7 is a top view of the ignition device of FIG. 6.

In FIGS. 6 and 7, an ignition device according to the present invention has been generally indicated by the reference numeral 35. In this embodiment, the ignition device 35 comprises a jacket-like body portion 37, of which the surface facing the fluidized sand 20 is furnished with rib-shaped heat transfer elements 38. Reference numeral 39 indicates a jacket-like heating member. This heating member 39 is circular in the particularly illustrated embodiment, however the shape of the heating member 39 may be alternatively rectangular or square.

The rib-shaped heat transfer elements 38 may be straight or inclined as in the previously-noted embodiments. Additionally, a lagging 40 is provided in the embodiment of the present invention illustrated in FIGS. 6 and 7, such that a space is defined between the jacket-like heating member 39 and the lagging 40, in which additional fluidized sand 20 may be disposed, so that there is fluidized sand 20 on both sides of the jacket-like heating member 39 and jacket-like body portion 37, as illustrated in FIGS. 6 and 7. The surface of the jacket-like heating member 39 opposite the jacket-like body portion 37 has also been furnished with rib-shaped heat transfer elements 38', as illustrated in these two figures, which may also be straight or inclined. With this particular ignition device, heat will be efficiently transferred into the fluidized sand 20 from both the inwardly-disposed rib-shaped heat transfer elements 38, as well as from the outwardly-disposed heat transfer elements 38'.

Figure 8:
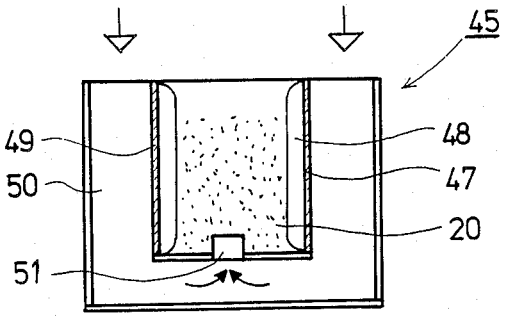
FIG. 8 is a schematic cross-sectional view of a fourth preferred embodiment of the ignition device of the present invention applied with respect to a heating boiler as in FIG. 1.

In the embodiment of the present invention illustrated in FIG. 8, the ignition device of the present invention has been generally indicated by the reference numeral 45. The ignition device illustrated in this figure is essentially the same as the embodiment illustrated in FIGS. 2 and 3, with the exception that lagging or equivalent structure encircling the ignition device 45 has been provided about the jacket-like body portion 47 in the embodiment illustrated in FIG. 8. Thus an intermediate space 50 is formed, through which combustion air is disposed to flow into the jacket-like body portion 47 through a tubular connector 51. A heating member 49 is also disposed to pre-heat the combustion air flowing through the intermediate space 50. This heating member 49 may be a helical electrical resistance as in the embodiments illustrated in FIGS. 2 and 3, or may be any other convenient type of heating member.

It is thus understood that in the embodiment of FIG. 8, the combustion air is pre-heated before entering the start-up section. During the combustion phase, this flowing air cools the overall structure, and the combustion section correspondingly pre-heats this flowing combustion air. Significantly smaller lagging thicknesses may be effectively employed with the ignition device illustrated in FIG. 8.

The preceding description of the present invention is merely exemplary, and is not intended to limit the scope thereof in any way.

What is claimed is:

1. An ignition device for a heating boiler having a combustion section operating according to the fluidized bed principle, said ignition device comprising a jacket body for containing a bed of fluidizable particles therewithin, heating means for heating the bed of fluidizable particles, said heating means being disposed on an outside surface of said jacket body facing aaway from the bed of fluidizable particles so that said heating means does not contact the fluidizable particles, and at least one heat transfer element disposed inside and on the surface of said jacket body facing the bed of particles, whereby said heat transfer element is in direct heat contact with said heating means and is in contact with, and by heat transfer can heat, the bed of particles.

2. The device of claim 1, additionally comprising a lagging surrounding said heating means, an intermediate chamber formed between said lagging and said heating means, for directing flow of combustion gas into the fluidizable bed of particles, and said heating means also constituting means for preheating the combustion gas prior to contacting the fluidizable bed of particles.

3. The device of claim 1, comprising a plurality of rib-shaped heat transfer elements disposed along the surface of said jacket body facing the bed of particles.

4. The device of claim 3, wherein said heat transfer elements are disposed substantially parallel to a longitudinal axis of said jacket body.

5. The device of claim 3, additionally comprising a second jacket body surrounding said heating means, a lagging surrounding said second jacket body for containing an additional bed of fluidizable particles therewithin, and a plurality of rib-shaped heat transfer elements disposed along a surface of said second jacket body facing said lagging.

6. The device of claim 3, wherein said heat transfer elements are inclined at an angle with respect to a longitudinal axis of said jacket body.

7. The device of claim 6, wherein said angle is in the range from about 0° to about 70°.

8. The device of claim 7, wherein said angle is in the range of about 0° to about 50°.

* * * * *